United States Patent [19]

Appenzeller

[11] 3,973,483

[45] Aug. 10, 1976

[54] APPARATUS FOR THE CONTINUOUS PRESSURE TREATMENT OF A WEB

[75] Inventor: Valentin Appenzeller, Kempen, Germany

[73] Assignee: Edward Kusters, Krefeld-Forstwald, Germany

[22] Filed: Feb. 26, 1974

[21] Appl. No.: 446,097

[30] Foreign Application Priority Data

Mar. 9, 1973 Germany ..... 2311909

[52] U.S. Cl. ..... 100/93 RP; 34/123; 100/153; 100/154; 162/290; 162/360 R

[51] Int. Cl.[2] ..... D21G 1/00; D21F 5/02

[58] Field of Search..... 162/305, 312, 358, 360 R, 162/361, 204, 205, 210, 206, 290, 313, 314; 100/93 RP, 121, 151, 152, 153, 154, 162 B; 34/123

[56] References Cited

UNITED STATES PATENTS

| | | | |
|---|---|---|---|
| 1,885,334 | 11/1932 | Darrah | 162/305 X |
| 3,471,363 | 10/1969 | Schmidt | 162/205 X |
| 3,528,883 | 9/1970 | Lundin | 162/358 |
| 3,799,052 | 3/1974 | Kusters et al. | 100/93 RP |
| 3,808,092 | 4/1974 | Busker | 162/205 |

*Primary Examiner*—S. Leon Bashore
*Assistant Examiner*—Richard V. Fisher
*Attorney, Agent, or Firm*—Kenyon & Kenyon Reilly Carr & Chapin

[57] ABSTRACT

Pressure treatment apparatus for continuous web treatment includes a drum and a belt surrounding the drum almost completely with both drum and belt being movable with the web disposed in between. A pair of essentially semi-cylindrical sleeves are disposed about the belt as a supporting surface with a friction-reducing means, such as interconnected rollers, between the sleeves and belt to transfer force. The sleeve ends are spaced apart at two sides to permit passage of the web and belt while at the same time being urged together of both sides to impart a tensile force in the sleeve. This tensile force serves to exert a uniform pressure on the moving web substantially over the entire surface of the drum with the forces contained in a closed system and not loading the drum bearings.

19 Claims, 7 Drawing Figures

APPARATUS FOR THE CONTINUOUS PRESSURE TREATMENT OF A WEB

FIELD OF THE INVENTION

This invention relates to an apparatus for the continuous pressure treatment of a web, and particularly to the continuous pressure treatment of webs of paper, textiles and the like.

BACKGROUND OF THE INVENTION

Heretofore, in the continuous pressure treatment of moving webs, it has been known to use pairs of rollers to compress the web as the web passes through the nip formed by each roller pair. Thus, the zone of action of the pressure is only the narrow roller nip, which in theory is merely a line but in practice, due to the thickness and compressibility of the material and the deformation of the roller surface, is a narrow zone. To enable treatment to be performed adequately, therefore, the treatment must often be repeated. Thus, the web has been guided through a number of successive roller nips, one after the other. This is done in known manner, for instance, in a paper calender which normally comprises stacks of up to twelve superimposed rollers over which the paper web is guided, being looped alternately over the successive rollers. The required pressure treatment is performed between each pair of rollers, and the total operative surface is the sum of the narrow pressure zones of the individual roller nips. However, this involves a considerable expense due to the large number of rollers needed to obtain the operative surface, a large roller stand and many drives.

In order to overcome the disadvantages of these systems, it has been known to use an apparatus for the continuous pressure treatment of webs in which the pressure is operative over a larger area than with rollers, without the expense of providing a large number of rollers connected one after the other. The basic concept of this apparatus is to extend the working nip, in which pressure is exerted between two rollers, over the surface of one roller or drum thus increasing the operative surface. To this end, the operative surface is increased by substituting a concurrently movable forming belt for the matching roller and by partly looping the forming belt around the drum. The web is guided between the co-rotating forming belt and drum and is pressure treated therebetween.

In this latter apparatus, the pressure which can be exerted on a web corresponds to the pressure under which the forming belt bears against the drum, and is determined by the tensioning of the forming belt. Such tensioning is usually subjected to fairly precisely defined limits. The forming belt is, of course, endless and must be deflected several times over rollers or drums in its path. The resulting bending causes tensile and compressive stresses in the material of the forming belt which must remain in the resilient zone, i.e., below the flow limit of the material of the belt. Since it is not possible to increase the drum radius a sufficient amount to improve the bending geometry, there is a maximum permissible belt thickness for any particular construction. From this belt thickness the maximum permissible tensile loading of the belt is determined. The resulting radial pressures are, however, inadequate to produce on a web, for instance, an effect comparable with the work of a calender.

German Pat. No. 923,172 issued in July 1955 discloses an apparatus for continuous pressing which includes a rotating drum having a steel forming belt looped around the surface by about 120°, the material to be pressed being disposed between the forming belt and the drum. In addition, a segment which has a supporting surface adapted to the outer shape of the forming belt is disposed outside of the forming belt and is pressed radially against the drum. Also, rolling members which transmit pressure from the supporting surface to the forming belt are rollably disposed between the steel belt and the supporting surface. When pressure is exerted in this way, there is no need for special belt tensioning, which is difficult to control.

However, the radial application of pressure by the supporting surface causes radial forces on the drum which must be absorbed by the drum bearing. Consequently, in the case of an apparatus for processing fairly wide webs such as, for instance, webs of paper, and also, if the zone of application of pressure is to be widened in the peripheral direction, bearing loadings can cause considerable technical problems. The expense of the apparatus would also be increased if attempts are made to attain pressures comparable with arrangements of rollers.

One solution to some of these problems is disclosed in U.S. Pat. No. 3,799,052 granted Mar. 26, 1974. This U.S. Pat. No. 3,799,052 discloses an apparatus for the continuous pressure treatment of a web comprising a rotatable drum, a movable forming belt looped about the drum and a sleeve forming a supporting surface about the belt. The sleeve is disposed about the drum surface for substantially more than 180° with a pair of opposed ends in spaced apart relation to form an axial nip for passage of the belt. In addition, friction-reducing means are provided between the sleeve and belt and means are interconnected to the ends of the sleeve to impart a tensile stress in the sleeve.

The sleeve is looped around the drum by more than 180° to terminate in a zone in which the ends of the sleeve approach one another after being looped around the drum. As a result of this and the tensile force existing between the ends of the sleeve, the sleeve can act like a tensioning belt whose tensioning in the peripheral direction exerts a radial force on the forming belt and the drum. The force corresponds to the pressure exerted on the web. Whereas in the prior art arrangement the force was directed from the supporting surface against the drum from one side, now, at least, a large proportion of the force is left inside the sleeve and kept away from the drum bearing.

As is more fully disclosed in that U.S. Pat. No. 3,799,052, which is hereby incorporated by reference, the tensioning arrangement results in a reduced loading of the support bearings of the rotating apparatus. Although that apparatus works quite well, the bearing still is loaded to some degree and thus, there is a need for an improved arrangement of this nature which offers the advantages of the aforesaid arrangement, while at the same time, further reducing or eliminating bearing forces.

SUMMARY OF THE INVENTION

This invention provides such an arrangement. Rather than using a sleeve which is looped around the drum almost completely, a pair of sleeves, each of essentially semi-cylindrical cross section are employed resulting in small openings at two sides of the arrangement.

Through the use of the two sleeves, the force applied by the sleeves to the forming belt (or pressure belt) can be kept within a closed system made up of the sleeves and their attached tensioning elements and thus, the placing of any additional load on the bearings is avoided, i.e., only the weight of the drum is on the bearings.

A number of different embodiments are illustrated. In one, a single pressure belt, as in the prior art, is used and in another, two separate belts, one associated with each of the semi-cylindrical sleeves is used. Also shown is the combination of the apparatus of the arrangement of the present invention with an additional press apparatus.

A number of different types of tensioning arrangements are disclosed, one using a common force element coupled to both ends of both sleeves and others in which separate tensioning elements are provided at each of the two gaps formed by the two separate sleeves. In one of these, I-beams are used to more evenly distribute the force. Also disclosed is the use of friction reduction means in the form of rolling members similar to those used in the embodiment of the above described U.S. Pat. No. 3,799,052.

DETAILED DESCRIPTION OF THE PREFERRED EMBODIMENT

Figure 1:
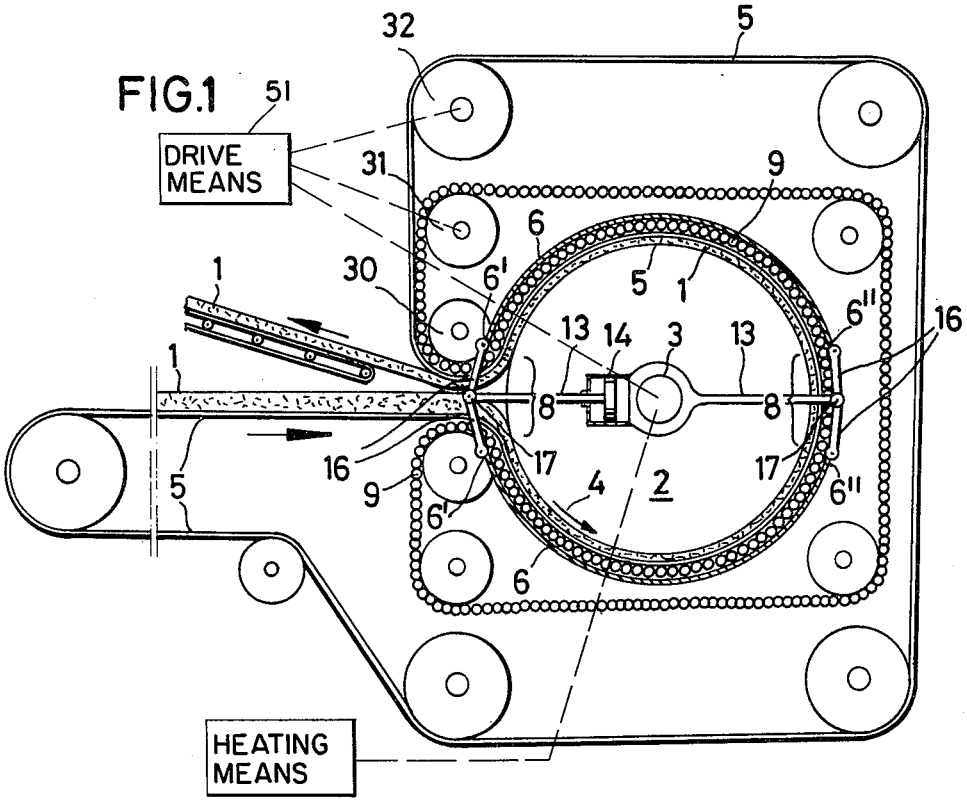
FIG. 1 is a simplified elevation view of a first embodiment of the present invention employing a single pressure belt.

FIG. 1 illustrates a first embodiment of the pressure apparatus of the present invention which is used for the continuous pressure treatment of a web such as a web of paper, textile or the like. As illustrated, the web 1 passes in meander fashion around a drum 2 which rotates on the axle 3 in the direction of arrow 4. The axle 3 is supported in bearings *3a*, not shown on this figure but visible in the view of FIG. 2. Traveling with the web on its outside is a pressure belt (also known as a forming belt) with the belt 5 arranged such that the web 1 is between it and the drum surface over a major portion of the drum 2. The web 1 shown in FIG. 1, may, for example, comprise a fiber mass which is pressed together and firmed into a plate-like thin web as it travels around the drum. On the outside side of the pressure belt 5, are placed two pressure elements or sleeve sections 6 which surround the drum 2 over a major portion of its circumferential surface, i.e., they are arranged such that only two relatively small gaps 8 are formed between the ends 6' and 6'' of the two sleeve sections. The gap 8 to the left of FIG. 1 is the entrance and exit point for the web 1 and the pressure belt 5, which web passes between the pressure element 6 and the drum surface. The pressure elements 6 have a cylindrical inner surface which is coaxial with the axle of drum 2. In order to minimize friction between the pressure belt 5 and the pressure elements or sleeves 6, roller chains 9 are installed between the sleeves 6 and the belt 5. These roller chains are densely packed over the width of the web 1 and provide a rolling transfer of pressure over the entire support surface of the pressure elements 6. The pressure elements 6 are supported by a support construction not shown in detail and are essentially stationary with respect to the rotating drum 2 and the traveling pressure belt 5.

The adjacent ends 6' and 6'' of the sleeves 6 are connected by tensioning elements 16 having pivot points 17. The pivot points 17 of tensioning elements 16 can be moved outwardly to result in the ends 6' and 6'' being pulled together to increase the pressure placed on the web. This pushing outward of the pivot point 17 is accomplished in the embodiment of FIG. 1 by a force element 14 which, in the illustrated embodiment, is a hydraulic cylinder. In well known fashion, control of element 14 will permit a regulated force to be applied to the web. Force is transferred from the hydraulic cylinder to the pivot points 17 of the tension element 16 through struts 13. With this arrangement, all forces remain within the strut arrangement with circumvents the axle 3 so that the axle is not subject to any forces due to this tensioning arrangement. In this manner, the pressure elements or sleeves 6, the tensioning elements 16, the strut 13 and the force element 14 form a closed forced system. Two sets of elements 14 and 16 will be installed, at each gap outside the width of the web. Because the gaps 8 are opposite each other, forces are symmetrical and no additional load is placed on the drum bearings.

Tension on the pressure elements 6, obtained through the pushing out of the tension rod 16, is transferred as a radial pressure onto the roller chain 9 which in turn transfers it, through the pressure belt 5, onto the web 1, causing the web to be pressed against the surface of the drum 2. Although, as noted above, the pressure elements 6 are stable, they are mounted in such a manner that they are not completely rigid and can move sufficiently so that the radial pressure operating through their circumferential tension is substantially uniform over the circumference of the drum 2. The pressure elements 6, can be made of steel sheet of six to twelve mm thick. Such shells are only minimally deformed in operation of the apparatus in contrast to the pressure belts which are constantly bending and changing direction. In selecting the size of the pressure belts therefore, a certain amount of leeway exists since the pressure belts are no longer used for the task of applying the pressure, this being done by the pressure shells. Thus, the belts can have a very small thickness to minimize the bending tensions. Because the force elements 14 and the tensioning elements 16 will normally be positioned beyond the edge of the web, the edges 6' and 6'' of the pressure element 6 are reinforced to avoid deflection.

As further illustrated on FIG. 1, the web 1 is led, along with the roller chain 9 over a roller 30. The belt 5 continues over rollers such as roller 32 until it again contacts the web 1 and enters the gap 8 over another roller at the bottom. The roller chain 9 follows a shorter path being deflected over rollers 31 in a more or less square pattern until it also enters at gap 8 again. Drive means 51 are provided for driving the drum 2 and also for driving the rollers 31 and 32 to move, respectively, the roller chain 9 and belt 5 if desired. Also shown on FIG. 1 are heating means for supplying heat to the inside of a drum 2. Alternatively, heat can be supplied to the pressure elements.

Figure 2:
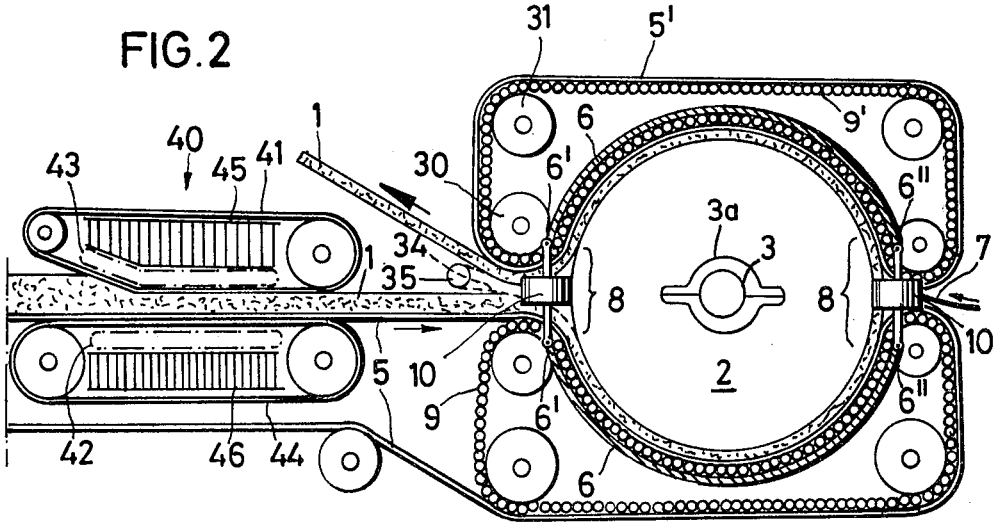
FIG. 2 is a corresponding view of a second embodiment using a different type of force element and having upper and lower pressure belts.

FIG. 2 illustrates a second embodiment of the present invention. In the embodiment illustrated thereon, two pressure belts 5 and 5′ are provided, one covering the upper half of the drum 2 and the other the lower half of the drum 2. Associated with the belts 5 and 5′ are separate roller chains 9 and 9′. Both the chain 9′ and the belt 5′ follow the same path being deflected over rollers 30 and 31 from the opening 8 at the left and back in to the opening 8 at the right. The bottom chain 9 follows a similar path at the bottom with the bottom belt 5 being directed over further rollers and through an additional pressure apparatus 40 to be described below.

The primary advantage of this arrangement is that webs passing between the drum and the pressure belt can pass through the right gap as well as the left gap. Thus, as illustrated on FIG. 2, a cover layer 7 for the web 1 can be introduced at the right hand side of the apparatus 2, between the upper pressure belt 5′ and the web 1, after which it will travel along with the web through the upper pressure zone under the pressure element 6. In this embodiment, the upper and lower pressure element 6 are connected at both ends 6′ and 6″ by force elements 10 in the form of tensioning elements. The entire arrangement of the pressure elements 6 along with force elements 10 is mounted in a frame, not shown, in appropriate fashion and again comprises a closed force system so that the axle 3 is not influenced by any of the forces exerted between the pressure element and the drum 2.

Figure 3:
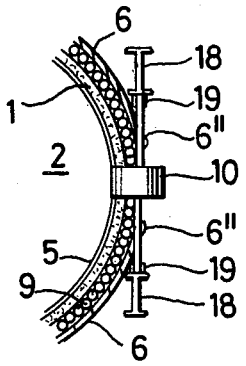
FIG. 3 is an illustration of a further type of force element.

FIG. 3 shows a further embodiment in which the tensioning force is obtained through the use of force elements 10 constructed as a tensioning element and operating between two I-beams 18, each extending over the width of the web. The force is transferred from the transverse I-beams to the ends 6″ of the pressure elements 6 through the use of force transmitting members 19 which extend over the width of the web. The transverse I-beam will take up any deflection forces which result from the force element 10 being positioned only at the sides of the arrangement. To uniformly distribute varying forces which may result from deflection, members 19 may be interconnected by hydraulic elements, i.e., hydraulic cushion elements.

The force elements 10 or 14 may be of different types. Spindles, hydraulic cylinders and other well known devices may be utilized. Since the distance of operation of the force elements 10 and 14 is small, large surface hydraulic elements with membrane-like pressure cushions are particularly suitable.

FIGS. 4 through 7 show various embodiments of roller chains 9 which may be used with the present invention.

Figure 4:
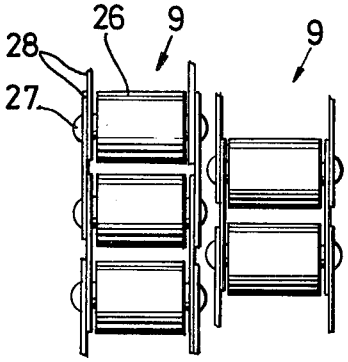
FIGS. 4 through 7 illustrate various types of roller chains which may be used in the embodiment of FIGS. 1, 2 and 3.

FIG. 4 illustrates conventional commercially available chains including rollers 26, links 28 and pins 27. A plurality of such may be used but will result in a gap between chains at which point no pressure will be applied.

Figure 5:
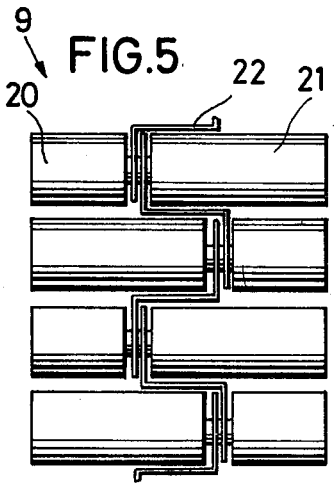

Referring to FIG. 5, the roller chain 9 comprises two rollers 20, 21 per link of different lengths disposed one beside the other. These rollers 20, 21 are also disposed alternately in successive links and are interconnected by bent straps 22. The rollers 20, 21 are mounted overhung and form aligned end faces, so that adjacent roller chains can be disposed directly one beside the other without leaving a gap. The rollers 20, 21 cover all places in the chain width, due to the offset arrangement of the gap between the rollers 20, 21 of each link.

Figure 6:
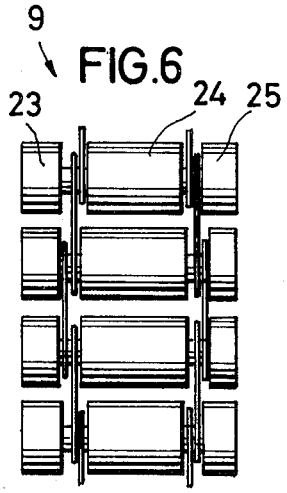

Referring to FIG. 6, the roller chain 9 can alternatively be constructed with three rollers 23–25 per link disposed one beside the other and having different lengths in successive links. The successive links are connected by straight straps, but, for a number of successive links, the straps are disposed offset towards the same side. As a result, the straps extend as a whole in a zig-zag shape inside a chain, and therefore a roller constantly rolls over each place in the chain width.

Figure 7:
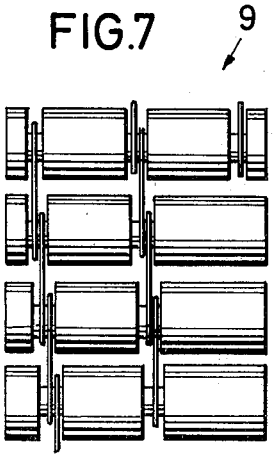

Referring to FIG. 7, the roller chain 9 can also be constructed substantially as shown in FIG. 6 but with straps that do not extend in zig-zag fashion. In this case, the straps always extend in the direction of the same side, the straps being discontinued when they approach a certain distance from the chain edge and being restarted on the opposite side of the chain.

A plurality of the chains illustrated in FIGS. 4 to 7 run directly one beside the other, but independently of one another, so that there are no difficulties with regards to tilting of the roller axes. Because of their freedom from gaps, the chains of FIGS. 5 to 7 are preferable where an even transfer of pressure is required.

The apparatus of FIGS. 1 to 3 may be used for the treatment of a large variety of web-type materials. For example, paper, pulp, synethetics and so on, can be subjected to pressure treatment in this type apparatus. It is also possible to form webs on an apparatus of this type. In such a case, it might possibly be advantageous to subject the material to be formed into the web to a preliminary pressure treatment. This is the purpose of the pressure arrangement 40 shown on FIG. 2. It includes two endless forming belts 41 and 44 which extend over the width of the web with the forming belt 41 in direct contact of the upper surface of the material to be formed and with the lower forming belt 44 abuting the lower surface of the pressure belt 5 which, as noted above, is led in a path which will take it through this apparatus. Support constructions 45 and 46, which are connected to one another beyond the edges of the web, are provided and pressure treating arrangements 42 and 43 are positioned between the support constructions 46 and 45 and forming belts 44 and 41 respectively.

As noted above, the belts 5 and chains 9 are passed over guide rollers 30, 31 and 32, positioned around the drum 2. One or more of these guide rollers may be constructed as idler rolls in order to provide the necessary tension on pressure belts 5 and 5′ and the roller chains 9, in order to obtain trouble free running. Tension of this nature contributes somewhat to the pressure of the surface of the drum 2 but is minor in comparison to the pressure obtained through tensioning of the pressure elements 6.

FIG. 2 also illustrates a further embodiment of the invention in which a further belt 34 is provided, which belt passes around the drum 2 and over a roller 35 positioned near the left gap 8. It is also possible for such a belt 34 to travel outside of the web 1. That is, it can travel between the pressure belts 5 and 5′ and the web 1. In a case such as that, the belt 34 would have to be passed around the guide rollers 32 as shown on FIG. 1.

The pressure belts 5 can basically be made of any appropriate material such as plastic or similar material. In the embodiment of FIG. 2 utilizing the additional belt 34, the pressure belts 5 and 5′ can be made of steel and the further belt 34 of a different material. This enables the use of different belts in accordance with the web and the manner in which it is to be treated.

For particular calendering effects in the treatment of paper, polyamide proved advantageous. Thus, the supplemental belt 34 can be made of polyamide, in which case a steel surface will act upon one side of the web and the polyamide on the other.

For some treatments of a web 1, for example, in order to achieve a calendering effect on paper or textiles, a frictioning effect on the surface is also desired. In order to obtain such, the pressure belts 5 and 5' or the supplemental belt 34 are driven independently of the drum 2 to result in a speed differential at the surface of web 1 which will result in the desired frictional effects. This can be accomplished by the use of the proper gearing ratios in the drive means 51. These and other modifications may be made without departing from the spirit of the invention which is intended to be limited solely by the appended claims.

What is claimed is:

1. An apparatus for the continuous pressure treatment of a web comprising a rotatable drum supported for rotation on an axle, said drum having a surface for engaging the web;

first and second sleeves in the shape of sections of a cylinder forming a supporting surface about said drum, said sleeves being disposed around said drum surface for substantially more than 180° forming two gaps at the opposed ends of said sleeves;

first and second movable pressure belts looped about said drum for concurrent movement therewith, each belt being associated with one of said sleeves, said belts entering between the drum and sleeve through one of said gaps and exiting through the other;

friction-reducing means between said sleeves and said belts;

means for feeding said web between said drum and one of said belts;

means for removing said web from between the other of said belts and said drum; and means interconnecting the ends of said sleeves at both of said gaps to impart a tensile stress in said sleeves with said tensile stress applied equally at both of said gaps.

2. An apparatus as set forth in claim 1 further including means for heating at least one of said drum and said sleeves.

3. An apparatus as set forth in claim 1 and further including means for driving said drum and at least one of said pressure belts at different peripheral speeds.

4. An apparatus as set forth in claim 1 wherein said first and second sleeves are bent steel plates.

5. An apparatus as set forth in claim 1 wherein said means interconnecting said sleeve ends includes controllable force elements for exerting a tensile stress on said sleeve ends.

6. An apparatus as set forth in claim 5 wherein said elements are disposed outside of the width of the web.

7. An apparatus as set forth in claim 6 wherein said elements are directly connected with said sleeve ends.

8. An apparatus as set forth in claim 6 wherein said force elements act upon beams positioned near said gaps outside thereof, said beams being positioned transversely over the width of the web and pressure transmitting means between the ends of said sleeves and said beams.

9. An apparatus as set forth in claim 5 wherein said interconnecting means comprise tension elements in the form of struts linked to said ends and to each other at a radially movable pivot point and said force elements comprise pressure elements coupled to move said pivot point radially outward.

10. An apparatus as set forth in claim 1 wherein said pressure belts are steel belts and which further comprises a third belt movably mounted between said steel belts and said drum.

11. An apparatus as set forth in claim 10 wherein the web is disposed to run between said third belt and said drum.

12. An apparatus as set forth in claim 10 wherein the web is disposed to run between said third belt and said pressure belts.

13. An apparatus as set forth in claim 10 wherein said third belt is made of a material having a different surface texture from steel.

14. An apparatus as set forth in claim 13 wherein said third belt is made of polyamide.

15. An apparatus as set forth in claim 1 wherein said pressure belts and said friction-reducing means run on endless paths extending around the outside of said drum.

16. An apparatus as set forth in claim 1 wherein said friction-reducing means includes a plurality of rolling members rollably disposed between said sleeves and said belts.

17. An apparatus as set forth in claim 15 wherein said friction-reducing means includes rolling members in the form of a large number of endless roller chains advancing closely adjacent to one another.

18. An apparatus as set forth in claim 17 wherein said roller chains are of a type wherein each roller segment includes a plurality of roller sections with successive segment having rollers of different size to avoid a continuous gap over the length of the chain.

19. An apparatus as set forth in claim 10 and further including means for driving said drum and at least one of said pressure belts at different peripheral speeds.

* * * * *